US008647804B2

(12) United States Patent
Mizutani et al.

(10) Patent No.: US 8,647,804 B2
(45) Date of Patent: Feb. 11, 2014

(54) METHOD OF PREPARING CARRIER FOR ELECTROPHOTOGRAPHY, CARRIER FOR ELECTROPHOTOGRAPHY, DEVELOPER FOR ELECTROPHOTOGRAPHY, PROCESS CARTRIDGE AND IMAGE FORMING APPARATUS

(75) Inventors: Yuuki Mizutani, Kanagawa (JP); Shinichiro Yagi, Shizuoka (JP); Kousuke Suzuki, Shizuoka (JP); Masato Taikoji, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 13/483,494

(22) Filed: May 30, 2012

(65) Prior Publication Data

US 2012/0315572 A1 Dec. 13, 2012

(30) Foreign Application Priority Data

Jun. 8, 2011 (JP) ..... 2011-128488

(51) Int. Cl.
*G03G 5/00* (2006.01)
*G03G 9/00* (2006.01)

(52) U.S. Cl.
USPC ..... 430/137.13; 430/111.3; 427/458

(58) Field of Classification Search
USPC ..... 430/111.1, 111.3, 111.31, 137.1, 430/137.13; 427/458, 475, 486
See application file for complete search history.

(56) References Cited

U.S. PATENT DOCUMENTS 4,209,550 A * 6/1980 Hagenbach et al. ..... 427/486
6,320,168 B1 * 11/2001 Kimata et al. ..... 219/619
7,144,669 B2 12/2006 Suzuki et al.
7,172,846 B2 2/2007 Yamashita et al.
7,252,919 B2 8/2007 Suzuki et al.
7,381,513 B2 6/2008 Suzuki et al.
7,384,719 B2 6/2008 Yamashita et al.
7,527,908 B2 5/2009 Iwatsuki et al.
8,026,032 B2 9/2011 Iwatsuki et al.
8,086,143 B2 12/2011 Nagayama et al.
8,162,059 B2 * 4/2012 Nguyen et al. ..... 166/302
2005/0079434 A1 4/2005 Suzuki et al.
2006/0228641 A1 * 10/2006 Suzuki et al. ..... 430/111.32
2006/0291911 A1 12/2006 Yamashita et al.
2007/0202430 A1 8/2007 Suzuki et al.

(Continued)

FOREIGN PATENT DOCUMENTS

JP 5-341579 12/1993
JP 7-120967 5/1995
JP 9-80951 3/1997

(Continued)

OTHER PUBLICATIONS

U.S. Appl. No. 13/425,675, filed Mar. 21, 2012, Taikoji, et al.

*Primary Examiner* — Stewart Fraser
(74) *Attorney, Agent, or Firm* — Oblon, Spivak, McClelland, Maier & Neustadt, L.L.P.

(57) ABSTRACT

A method of preparing carrier for electrophotography, which includes a core material and a coating material layer formed on the surface of the core material, including coating a coating material of the coating material layer on the core material; and burning the coating material by an induction heater, wherein the induction heater applies an alternative current to parallely-located plural coil circuits including a conductive wire including the shape of a coil to generate a magnetic line changing its direction and intensity for inductively heating the core material to heat the coating material.

7 Claims, 6 Drawing Sheets

(56) References Cited

U.S. PATENT DOCUMENTS

| | | | | |
|---|---|---|---|---|
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2008/0264330 | A1* | 10/2008 | Wilkes et al. | 117/3 |
| 2009/0142678 | A1 | 6/2009 | Yagi et al. | |
| 2012/0008979 | A1* | 1/2012 | Suzuki et al. | 399/111 |
| 2012/0264042 | A1* | 10/2012 | Taikoji et al. | 430/105 |

FOREIGN PATENT DOCUMENTS

| | | |
|---|---|---|
| JP | 2001-185338 | 7/2001 |
| JP | 2005-59379 | 3/2005 |
| JP | 2009-109676 | 5/2009 |
| JP | 2010-282168 | 12/2010 |

* cited by examiner

METHOD OF PREPARING CARRIER FOR ELECTROPHOTOGRAPHY, CARRIER FOR ELECTROPHOTOGRAPHY, DEVELOPER FOR ELECTROPHOTOGRAPHY, PROCESS CARTRIDGE AND IMAGE FORMING APPARATUS

CROSS-REFERENCE TO RELATED APPLICATIONS

This patent application is based on and claims priority pursuant to 35 U.S.C. §119 to Japanese Patent Application No. 2011-128488 filed on Jun. 8, 2011. in the Japanese Patent Office, the entire disclosure of which is hereby incorporated herein by reference.

FIELD OF THE INVENTION

The present invention relates to a method of preparing a carrier for electrophotography, which is one of constituents forming a developer for electrophotography, and to a developer for electrophotography including the carrier for electrophotography, and a process cartridge and an image forming apparatus using the carrier for electrophotography.

BACKGROUND OF THE INVENTION

In electrophotographic image forming apparatuses such as copiers, printers and facsimiles, a developer has an important role in finally visualizing an image and technical development thereof is very actively made. Particularly, a mainstream dry two-component developer is formed of a particulate magnet called a carrier and a particulate resin including a colorant called a toner.

The carrier is a magnetic powder including a core material and a thin resin layer formed thereon for the purpose of controlling resistivity, imparting chargeability and improving durability, and is prepared by coating a coating liquid on the core material, burning and sifting.

Japanese published unexamined application No. 2010-282168 discloses using a burner such as an electric oven and rotary kiln in a burning process of preparing a carrier.

However, these burners heat heaters to heat air, and the heated air heats the particulate carrier. The particulate carrier is indirectly heated through air having low heat conductivity. Therefore, the energy efficiency is low and a specific energy consumption (an energy requited to produce a unit weight [kWh/kg]) is large.

In order to solve this problem, using a high-frequency induction heating in the burning process of preparing a carrier is discussed.

The high-frequency induction heating is a method of heating metals, using an electromagnetic induction phenomenon. Two iron losses called an eddy-current loss and a hysteresis loss heat the conductive core material of a carrier.

The eddy-current loss is an iron loss generating a Joule heat because an eddy current caused by a magnetic line generated from a conductive line a high-frequency current flows through flows through the core material having electrical resistance.

The hysteresis loss is an iron loss generating a heat when a magnetic flux generated in the core material causes a hysteresis phenomenon when a high-frequency current flows through a coil.

In the high-frequency induction heating, the core material is heated by a heat generated from each of the two iron losses to dry a solvent remaining in a coated film and heat a resin.

Therefore, each core material can directly be heated not through a medium such as air, and the high-frequency induction heating is expected to be a burning method having a very small specific energy consumption.

However, a voltage, a current and a frequency are thought limited in using a high-frequency induction heater. Hereinafter, the limitation is explained.

FIG. 16 is a circuit diagram of a resonance LCR circuit included in a high-frequency induction heater.

In the resonance LCR circuit in FIG. 16, the following relationship is satisfied:

$$Vc=Q\times V$$

wherein Vc represents a voltage resistance of a condenser and V represents a source voltage.

Further, the following relationship is satisfied as well:

$$Q=\frac{1}{R}\sqrt{\frac{L}{C}}$$

wherein R represents a resistance, L represents an inductance and C represents a condenser capacity.

When "Q" formula is substituted in "Vc" formula, the following relationship is satisfied:

$$Vc=\frac{1}{R}\sqrt{\frac{L}{C}}\,V$$

Therefore, the source voltage V is represented by the following formula:

$$V=Vc\cdot R\cdot(C/L)^{0.5} \quad (1)$$

wherein V represents the source voltage, Vc represents the voltage resistance of a condenser, R represents the resistance, C represents the condenser capacity, and L represents the inductance.

In the induction heating, the larger an intensity of a magnetic field formed of a current flowing a coil, the larger a calorie supplied to a carrier per a unit time, and the productivity is increased. The intensity of a magnetic field is proportional to the number of coil turns per a unit length and a current. The source voltage V needs increasing to increase a current flowing through a circuit having the fixed resistance R and the fixed inductance L. From the formula (1), when a carrier having a fixed resistance R is burned with a coil having a fixed inductance L, the voltage resistance of a condenser and the condenser capacity need increasing to increase the source voltage V. However, the source voltage V is limited because the voltage resistance and the capacity of a condenser are both limited.

Typically, a current is represented by the following formula:

$$I_0=V_0/R_0$$

wherein $I_0$ represents a circuit current, $V_0$ represents a source voltage and $R_0$ represents a circuit resistance.

Therefore, $I_0$ is thought limited when $V_0$ is limited.

A current frequency in the resonance circuit is represented by the following formula:

$$f=1/2\pi[1/(L\cdot C)]^{0.5} \quad (2)$$

wherein f represents a frequency, L represents the inductance and C represents the condenser capacity.

The higher the frequency of a current, the lower a depth of penetration of an induction current generated in a conductive material to be heated. Therefore, the higher the frequency of a current, the more efficiently a small particulate carrier can be heated. However, from the formula (2), when a carrier is burned with a coil having a fixed inductance L, the condenser capacity C must be decreased to increase the current frequency f, but the condenser capacity C is limited. Further, as the formula (1) shows, when the condenser capacity C decreases, the source voltage V decreases as well, which is not necessarily be effective to increase burning efficiency, and the current frequency f is limited as well. In addition, the high-frequency induction heater has a fixed rated frequency, a high-frequency oscillator included therein cannot be oscillated with a frequency out of the fixed rated frequency.

From the formula (2), it is obvious that decreasing the inductance L enables the source voltage V and the current frequency f to increase without receiving limit of the condenser capacity C. Effective means of decreasing the inductance L include decreasing the number of coil turns. However, the intensity of a magnetic field is proportional to the number of coil turns per a unit length and a current. Therefore, when the number of coil turns is decreased while the number of coil turns per a unit length is maintained, the coil has a short length and a heating area narrows. When the number of coil turns is decreased while the length of the coil is maintained, an electric power required to burn a specific amount of a carrier increases, and a specific energy consumption is thought to deteriorate.

In this manner, the source voltage V, a circuit current I and the frequency f are limited in burning a carrier by a high-frequency induction heater, the oscillating capability of the high-frequency oscillator is not fully drawn, resulting in poor specific energy consumption.

Because of these reasons, a need exist for a method of preparing carrier for electrophotography, which has high productivity and low specific energy consumption.

SUMMARY OF THE INVENTION

Accordingly, one object of the present invention to provide a method of preparing carrier for electrophotography, which has high productivity and low specific energy consumption.

Another object of the present invention to provide a carrier for electrophotography prepared by the method.

A further object of the present invention to provide a developer for electrophotography, which includes the carrier for electrophotography.

Another object of the present invention to provide a process cartridge using the carrier for electrophotography.

A further object of the present invention to provide an image forming apparatus using the carrier for electrophotography.

These objects and other objects of the present invention, either individually or collectively, have been satisfied by the discovery of a method of preparing carrier for electrophotography, which comprises a core material and a coating material layer formed on the surface of the core material, comprising:

coating a coating material of the coating material layer on the core material; and burning the coating material by an induction heater, wherein the induction heater applies an alternative current to parallely-located plural coil circuits comprising a conductive wire comprising the shape of a coil to generate a magnetic line changing its direction and intensity for inductively heating the core material to heat the coating material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a method of preparing carrier for electrophotography, which has high productivity and low specific energy consumption.

More particularly, the present invention relates to a method of preparing carrier for electrophotography, which comprises a core material and a coating material layer formed on the surface of the core material, comprising:

coating a coating material of the coating material layer on the core material; and burning the coating material by an induction heater, wherein the induction heater applies an alternative current to parallely-located plural coil circuits comprising a conductive wire comprising the shape of a coil to generate a magnetic line changing its direction and intensity for inductively heating the core material to heat the coating material.

In a burning process of the present invention, induction heating directly heating a core material not through a medium such as air can heat the core material more efficiently than a burning process using a conventional burner.

Further, in the present invention, an induction heater including parallely-located plural coil circuits including a conductive wire including the shape of a coil is used. As Table 1 mentioned later shows, an induction heater in which coil circuits are located in parallel has higher carrier production capacity and lower specific energy consumption than an induction heater in which coil circuits are located in series.

This is thought to be because of the following reasons.

When coil turns per unit length are n and total coil turns are 2N, 2N turns coil in series and N turns coil in parallel are thought. The number of coil turns per unit length and the number of total coil turns are same, and a series coil and a parallel coil have no difference in a heatable area width. The parallel coil decreases a sum of coil resistance and inductance and a current value for an electric source voltage is larger than that of the series coil. A magnetic field intensity is proportional to the coil turns per unit length and a current, and when the number of coil turns per unit length is same, the parallel coil is thought to increase production capacity.

Further, the parallel coil decreases the inductance L and increases the current frequency f in formula (2), and is thought to efficiently heat a small particulate carrier and decrease the specific energy consumption.

Hereinafter, an embodiment of the present invention applied to an electrophotographic copier (hereinafter referred as a copier 500) is explained.

Figure 2:
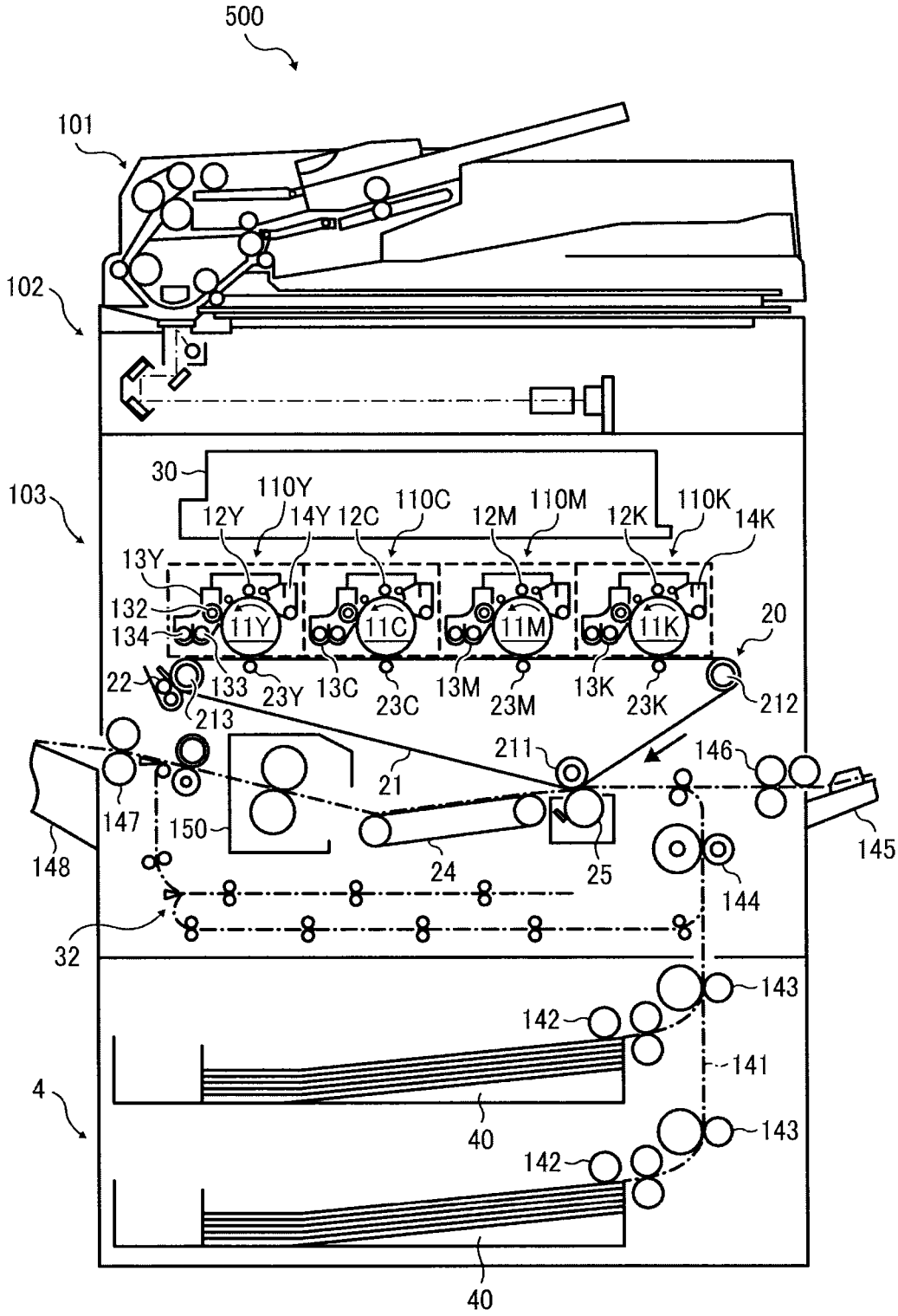
FIG. 2 is a schematic view illustrating an embodiment of the image forming apparatus of the present invention.

FIG. 2 is a schematic view explaining configuration of the copier 500.

As FIG. 2 shows, the copier 500 includes an automatic document feeder (ADF) 101 feeding a document, a scanner 102 scanning an image on the document, an image former 103 forming an image based on image data scanned by the scanner 102 and a paper feeder 4 feeding a transfer paper to the image former 103.

As FIG. 2 shows, the image former 103 includes four process units 110 (K, M, C and Y) forming respective black, magenta, cyan and yellow toner images. K, M, C and Y represent magenta, cyan and yellow colors, respectively.

Figure 3:
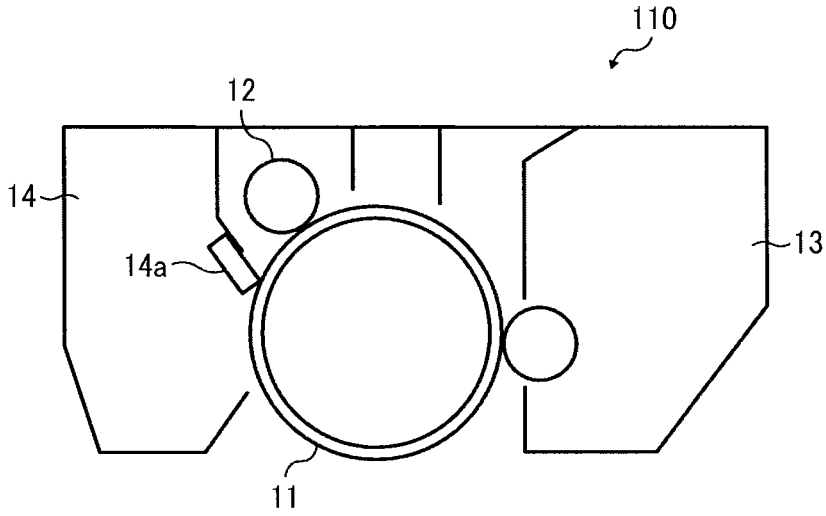
FIG. 3 is a schematic view illustrating an embodiment of the process cartridge of the present invention.

FIG. 3 explains one of the four process units 110 (K, M, C and Y), and they have almost the same configurations except for toner color and subscripts representing respective colors are omitted in FIG. 3 and properly omitted hereafter.

Each of the four process units 110 includes a photoreceptor 11 bearing a each color toner image. Around each of the photoreceptors 11, a charger 12, an image developer 13, a photoreceptor cleaner 14, etc. are located. The charger 12 uniformly charges the surface of the photoreceptor 11 and the image developer 13 develops an electrostatic latent image formed on the surface of the photoreceptor 11. The photoreceptor cleaner 14 cleans the surface of the photoreceptor 11 after a toner image is transferred.

The process unit 110 is a process cartridge including the photoreceptor 11 and other units such as the charger 12, the image developer 13 and the photoreceptor cleaner 14, etc., and is detachable from the image former 103.

The image former 103 includes an optical writer 30 irradiating the surface of the photoreceptor 11, which is uniformly charged by the charger 12 with a laser beam including image information to form an electrostatic latent image thereon. The optical writer 30 includes a laser beam source, a polygon mirror, a f-θ lens, a reflection mirror, etc., and irradiates the surface of the photoreceptor 11 which is driven to rotate while scanning in a main scanning direction with a laser beam, based on image data at a predetermined irradiating position.

Further, the image former 103 includes a transfer unit 20 transferring a toner image formed on the photoreceptor 11 onto a transfer paper and a fixer 150 fixing the toner image thereon.

The transfer unit 20 includes an intermediate transfer belt 21 driven to rotate in an arrow direction, which is extended by plural extension rollers 211, 212 and 213 with tension. The transfer unit 20 forms a first transfer nip, sandwiching the intermediate transfer belt 21 between the four photoreceptors 11 and four first transfer rollers 23 a predetermined voltage is applied to. In addition, the transfer unit 20 forms a second transfer nip, sandwiching the intermediate transfer belt 21 between the second backup roller 211 and a second transfer roller 25 a predetermined voltage is applied to. Further, the transfer unit 20 includes a belt cleaner 22 removing an untransferred toner remaining on the intermediate transfer belt 21.

Each of the four image developers 13 installed in the each of the four process units 110 includes a negatively-charged different color toner with a carrier. The image developer 13 includes a developing sleeve 132 facing the photoreceptor 11 and bearing a developer on its surface with a magnetic field generator included therein. In addition, the image developer 13 includes two screw members 133 and 134 mixing a toner fed from an unillustrated toner bottle with a two-component developer included in the image developer 13 and transferring the developer while stirring. The developing sleeve 132 draws a two-component developer including a toner and a carrier onto its surface while rotating like surface movement at a position facing the photoreceptor 11 in the same direction, and feeds the toner to a latent image on the surface of the photoreceptor 11 to form a toner image.

Each of color toner images formed on the photoreceptor 11 is sequentially transferred onto the intermediate transfer belt 21 where they are overlapped at the first transfer nip. The overlapped four color toner images formed on the intermediate transfer belt 21 are transferred onto a transfer paper at a time at the second transfer nip. After this, an untransferred toner remaining on the intermediate transfer belt 21 is removed by the belt cleaner 22.

Below the transfer unit 20, the fixer 150, a paper feed unit 24 and a pair of registration rollers 144 are located. The paper feed unit 24 endlessly moves an endless paper feed belt suspended between the second transfer roller 25 and the fixer 150. The pair of registration rollers 144 sandwiches a transfer paper fed from the paper feeder 4 between the rollers and feed the transfer paper to the second transfer nip in synchronization with the four color toner images formed on the intermediate transfer belt 21. A transfer paper a full-color image is transferred on, having passed the second transfer nip is released from the intermediate transfer belt 21 and fed to the fixer 150 by the paper feed unit 24. A transfer paper fed to the fixer 150, after a full-color image is fixed thereon with heat and pressure therein, is fed to a pair of paper discharge rollers 147 to be discharged on a paper discharge tray 148.

Below the image former 103, a both side feeder 32 is located. The both side feeder 32 changes over the direction of a transfer paper an image is fixed on one side thereof to a transfer paper reverser such that the transfer paper is reversed to enter the second transfer nip again.

The paper feeder 4 includes multi-stage paper feed cassettes 40 each containing a batch of paper including plural transfer papers, and a paper feed roller 142 is pressed against the uppermost transfer paper in the paper feed cassette 40. When the selected paper feed roller 142 is driven to rotate, the uppermost transfer paper is separated by a separation roller and fed to a paper feed path 141 one by one. The transfer paper fed to the paper feed path 141 is led to a paper feed path in an image forming unit 1 through plural pair of feed rollers 143, and sandwiched between a pair of registration rollers 144.

In the image former 103, an image is formed as follows.

In the process unit 110*k* for black, e.g., a laser beam modulated and deflected by the optical writer 30 is irradiated on the surface of the photoreceptor 11K uniformly charged by the charger 12K while scanned to form an electrostatic latent image. The electrostatic latent image on the photoreceptor 11K is developed by the image developer 13K to form a black toner image. The toner image on the photoreceptor 11K is transferred onto a transfer paper at the first transfer nip facing the first transfer roller 23K through the intermediate transfer belt 21. The surface of the photoreceptor 11K after the toner image is transferred is cleaned by the cleaner 14*k* and prepared for forming the following electrostatic latent image.

The other process units 110M, 110C and 110Y perform the same image forming process in synchronization with the intermediate transfer belt 21. A transfer paper fed from the paper feed cassette 40 is fed out by the pair of registration rollers 144 at a predetermined timing to the second transfer nip. Alternatively, a transfer paper fed from a manual tray 145 located at a side of the image former 103 is fed in a manual paper feed path by a paper feed roller, and fed out by pair of registration rollers 146 at a predetermined timing to the second transfer nip. The transfer paper a full-color image is transferred on at the second transfer nip at a time is fed by the paper feed unit 24 to the fixer 150 where the toner image is fixed.

In one-side print mode printing only on one side of the transfer paper, the transfer paper sandwiched in a paper discharge nip between the pair of paper discharge rollers 147 is discharged out of the apparatus and stacked on the paper discharge tray 148. In both-side print mode printing on both sides of the transfer paper, the transfer paper sandwiched between the pair of paper discharge rollers 147 is returned in a reverse direction and enters the both side feeder 32. In the both side feeder 32, the transfer paper is reversed and fed to the second transfer nip again. After the second transfer and fixation are performed on the other side of the transfer paper, the transfer paper is discharged by the pair of paper discharge rollers 147 onto the paper discharge tray 148. A residual toner remaining on the intermediate transfer belt 21 after the toner image is transferred is removed by the cleaned by the belt cleaner 22 and prepared for the following image formation of the process unit 110.

The above-mentioned image formation is an operation in overlapped four color (full-color) mode. In black and white image forming mode, among the extension rollers for the intermediate transfer belt 21, the extension rollers 212 or 213 besides the second transfer backup roller 211 is moved to separate the photoreceptors 11 (Y, M and C) from the intermediate transfer belt 21, and only a K toner image is formed thereon.

Next, the method of preparing the carrier for electrophotography of the present invention included in a two-component developer used in the copier 500 is explained.

Figure 1:
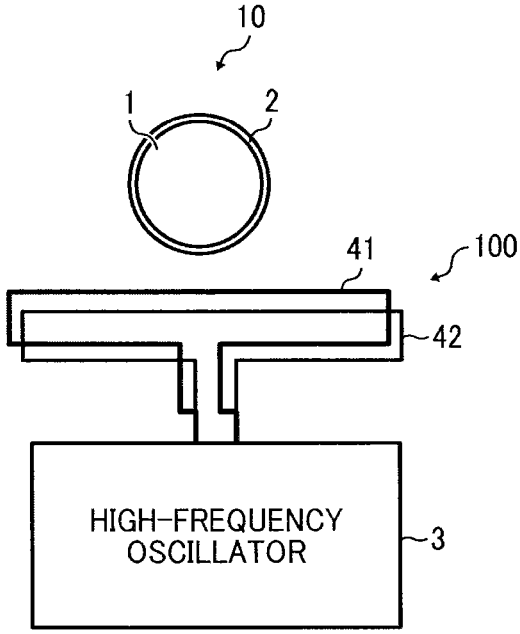
FIG. 1 is a schematic view illustrating the burning process of the method of preparing the carrier of the present invention.

FIG. 1 is a schematic view illustrating the burning process of the method of preparing the carrier of the present invention.

In the burning process of the present invention, a core material 1 coated with a coating material 2 is heated to prepare a particulate carrier 10 which is the of the present invention a coated layer is formed on.

An induction heater 100 heating by high-frequency induction heating includes a high-frequency oscillator 3 which is an electric source and a conductive wire connected therewith, which is branched to plural coil circuits (a first coil circuit 41 and a second coil circuit 42) located in parallel.

In FIG. 1, the second coil circuit 42 is shown in dashed line because of overlapped with the first coil circuit 41. The second coil circuit 42 does not have a particular difference with the first coil circuit 41.

The carrier is heated by high-frequency induction heating with two iron losses called an eddy-current loss and a hysteresis loss.

The eddy-current loss gives the following energy to a carrier.

$$P_e=K_e(tfB_m)^2/\rho$$

wherein $P_e$ represents the eddy-current loss which is an energy, t represents a thickness of the core material, f represents a frequency, $B_m$ represents a maximum magnetic flux density, ρ represents is a resistivity of the magnetic core material and $K_e$ represents a proportional constant.

The frequency of the current is determined by the formula (2) and the paralleled coil decreases the inductance (L) of the formula (2) to increase the frequency of the current (f), and an energy given to the carrier becomes large.

The hysteresis loss is a heat when a magnetic flux generated in the carrier when a high-frequency current is applied to a coil at the center of which the carrier is located causes a hysteresis phenomenon. An energy given to the carrier is determined as follows.

$$\mathrm{Ph}=\eta\cdot B_m^{1.6}\cdot f\cdot V$$

wherein Ph represents a hysteresis loss which is an energy, η is a hysteresis constant, $B_m$ represents a maximum magnetic flux density, f represents a frequency and V represents a volume of the core material.

The frequency of the current is determined by the formula (2):

$$f=1/2\pi[1/(L\cdot C)]^{0.5} \quad (2)$$

wherein f represents a frequency, L represents the inductance and C represents the condenser capacity.

Therefore, the paralleled coil decreases the inductance of the whole circuits and the carrier can be burned efficiently using a frequency close to the rated frequency, and an energy given by the hysteresis loss to the carrier becomes large.

The high-frequency induction heating in the present invention typically includes high-frequency induction heating, induction heating, electromagnetic induction heating, IH (Induction Heating), etc. Its heating principle is mentioned above and has high energy efficiency because of being capable of directly heating a conductive material not through a medium. Metals usable in high-frequency induction heating are not particularly limited provided they are electroconductive, but need to have resistivity to some extent to increase heating efficiency.

Figure 4:
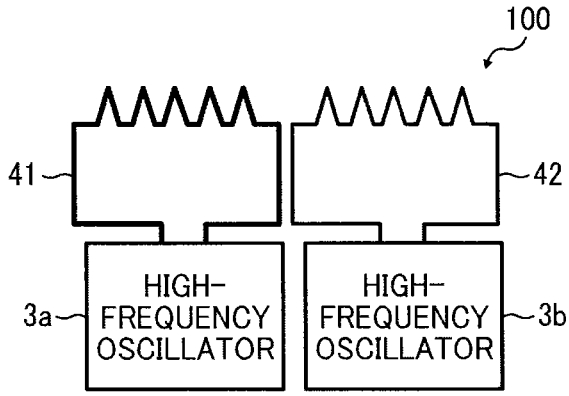
FIG. 4 is a schematic view illustrating an induction heater in which two coil circuits connected to two electric sources, respectively are laid in a line to physically be parallel.

In FIG. 1, a high-frequency current supplied from the high-frequency oscillator 3 runs through the first and second coil circuits 41 and 42 to generate an alternating magnetic field, which repeatedly magnetizes the core material 1 coated with the coating material 2 to generate a heat heating the coating material 2. The plural parallel coil circuits in the present invention are not necessarily connected with a common electric source. For example, as FIG. 4 shows, a configuration of plural coil circuits (a first coil circuit 41 and a second coil circuit 42) connected with different electric sources (a first high-frequency oscillator 3*a* and a second high-frequency oscillator 3*b*) in line, which are physically in parallel is included in the present invention as well.

Figure 5A:
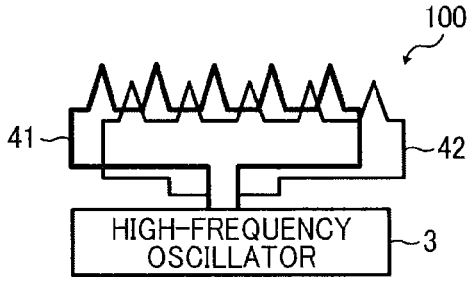
FIGS. 5A and 5B are explanatory views illustrating methods of locating plural coil circuits in parallel, and 5A is an alternate parallel and 5B is a connected parallel.
Figure 5B:
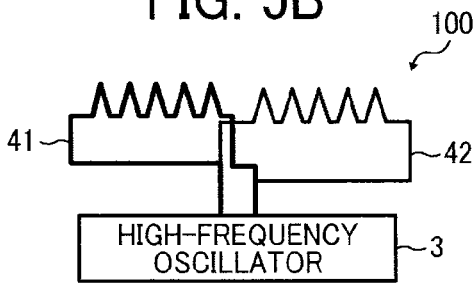

Methods of locating plural coil circuit in parallel include an alternating parallel in FIG. 5A and a connected parallel in FIG. 5B.

The alternating parallel in FIG. 5A includes a first coil circuit 41 and a second coil circuit 42, every coil of which is alternately located. The connected parallel in FIG. 5B does not overlap coils and independently locates every coil circuit.

The alternating parallel and the connected parallel have good process preciseness and preferably draw capability of the high-frequency oscillator 3.

Methods of locating plural coil circuit in parallel include differentiating the number of coil turns of every coil circuit as well. Changing the number of coil turns of every coil circuit located in parallel as desired can control the inductance as desired, and a carrier can be burned in a frequency domain close to the maximum of the rated frequency. Typically, the larger the difference of the number of coil turns of every coil circuit, the resistivity of the all circuits is small relative to the number of coil turns of the all circuits forming the induction heater 100. and the production capacity and the specific energy consumption are preferably improved.

Currents applied from the high-frequency oscillator 3 to each of the coil circuits preferably have the same phase frequency.

Namely, when plural high-frequency oscillators 3 are in line to form a parallel configuration as FIG. 4 shows, the larger the phase difference of the current frequency, the more the frequencies interfere with each other, and when the phase difference is 180[°], the frequencies completely negate each other. Therefore, the currents applied to the two coil circuits preferably have the same phase frequency to improve the production capacity and the specific energy consumption.

Resins forming the coating material 2 coating the core material 1 in the present invention include, but are not particularly limited to, if typically used for the carrier such as silicone resins, fluorine-containing resins and acrylic resins. These resins can be used alone or in combination, and can also be modified.

Specific examples of the core material for the carrier of the present invention include, but are not limited to, known carriers for electrophotographic two-component developers, such as iron, ferrite, magnetite, hematite, cobalt, Mn—Mg—Sr ferrite, Mn ferrite, Mn—Mg ferrite, Li ferrite, Mn—Zn ferrite, Cu—Zn ferrite, Ni—Zn ferrite and Ba ferrite, which can be selected in accordance with usage.

The following is an example of methods of preparing the carrier of the present invention, but the methods thereof are not limited thereto.

This is an outline of a method of preparing the carrier.

Measurement of materials→dispersing a coating liquid→coating→burning→sifting

Namely, materials measured to have desired ratios are dispersed by a disperser to prepare a dispersion. Specific examples of the disperser include any typically-used dispersers such as homomixers, rotary blade dispersers (Ebara Milder, Cavitron, etc.) and beads mill.

The dispersion is coated as the coating material 2 on the surface of the core material 1 by a coater to form a coated layer thereon. Specific examples of the coaters include any typically-used coaters such as rolling fluidized bed using a spray and a method of dipping the core material in the dispersion and drying the solvent.

The coated layer is burned to dry and promote heating. Finally, the agglomerated particles after burned are broken.

Specific examples of the breaker include any sifters if particles are sifted to each one peace, such as vibration shifters and ultrasonic vibration sifters. Further, the sifter not only breaks he agglomerated particles but also removes coarse or foreign particles.

Thus, the carrier particles of the present invention are prepared. This is just an example of the methods of preparing them, and the methods are not limited thereto.

The carrier for electrophotography is mixed with a toner for electrophotography to form a developer for electrophotography.

Conventional toners for electrophotography regardless of monochrome toners, color toners and full-color toners, can be used in the present invention, such as toners prepared by pulverization methods and polymerization methods.

Further, an oilless toner including a release agent can also be used. The release agent tends to transfer to a carrier, but the carrier of the present invention well prevents the release agent from transfer thereto, and produces quality images for long periods. Particularly, the carrier of the present invention is preferably used with an oilless full-color toner including a soft binder resin.

Specific examples of a binder resin for use in the toner for electrophotography include known resins, e.g., a monomer of styrene and its derivative such as polystyrene, poly-p-styrene and polyvinyltoluene; a styrene copolymer such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; poly(methyl methacrylate), poly(butyl methacrylate), polyvinylchloride, polyvinyl acetate, polyethylene, polyester, polyurethane, epoxy resin, polyvinyl butyral, poly(acrylic acid), rosin, modified rosin, terpene resin, phenolic resin, aliphatic or aromatic hydrocarbon resin, aromatic petroleum resin etc. These can be used alone or in combination.

Specific examples of a binder resin for pressure-fixing include known resins, e.g., polyolefin such as low-molecular weight polyethylene and low-molecular weight polypropylene; olefin copolymer such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer and ionomer resin; epoxy resin, polyester, styrene-butadiene copolymer, polyvinylpyrrolidone, methyl vinyl ether-anhydrous maleic acid copolymer, maleic acid-modified phenolic resin, phenol-modified terpene resin etc. These can be used alone or in combination, but the resins are not limited thereto.

The toner for electrophotography may include a fixing aid besides the binder resin, a colorant and a charge controlling agent. This is why the toner can be used in an oilless system having a fixing system not applying an oil on a fixing roller such that a toner does not adhere thereto. Specific examples of the fixing aid include, but are not limited to, polyolefin such as polyethylene and polypropylene, fatty acid metal salt, fatty acid ester, paraffin wax, amide wax, polyhydric wax, silicone varnish, carnauba wax and ester wax etc.

Specific examples of the colorants include known pigments and dyes capable of forming yellow, magenta, cyan and black toners. Specific examples of yellow pigment include, but are not limited to, cadmium yellow, mineral fast yellow, nickel titanium yellow, Naples yellow, naphthol yellow S, Hansa yellow G, Hansa yellow 10G, benzidine yellow GR, quinoline yellow lake, permanent yellow NCG and tartrazine lake.

Specific examples of orange pigments include, but are not limited to, molybdenum orange, permanent orange GTR, pyrazolone orange, Vulcan orange, indanthrene brilliant orange RK, benzidine orange G and indanthrene brilliant orange GK.

Specific examples of red pigments include, but are not limited to, iron red, cadmium red, permanent red 4R, lithol red, pyrazolone red, watching red calcium salt, lake red D, brilliant carmine 6B, eosin lake, rhodamine lake B, alizarin lake and brilliant carmine 3B.

Specific examples of violet pigments include, but are not limited to, fast violet B and methyl violet lake.

Specific examples of blue pigments include, but are not limited to, cobalt blue, alkali blue, Victoria blue lake, phthalocyanine blue, non-metal phthalocyanine blue, phthalocyanine blue-partly chloride, fast sky blue and indanthrene blue BC.

Specific examples of green pigments include, but are not limited to, chromium green, chromium oxide, pigment green B and malachite green lake.

Specific examples of black pigments include, but are not limited to, carbon black, oil furnace black, channel black, lamp black, acetylene black, an azine color such as aniline black, metal salt azo color, metal oxide, complex metal oxide.

These colorants can be used alone or in combination.

The toner for electrophotography may further include a charge controlling agent when necessary. The charge controlling agent is not particularly limited, and nigrosine; an azine dye having an alkyl group having 2 to 16 carbon atoms (see Japanese Examined Patent Publication No. 42-1627); a basic dye such as C. I. Basic Yellow 2 (C. I. 41000), C. I. Basic Yellow 3. C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoylmethylhexadecylammonium chloride and decyltrimethyl chloride; a dialkyltin compound such as dibutyl and dioctyl; a dialkyltin borate compound; a guanidine derivative; a polyamine resin such as vinyl polymer having an amino group and condensation polymer having an amino group; a metal complex salt of monoazo dye described in Japanese Examined Patent Publication No. 41-20153, 43-27596, 44-6397 and 45-26478; salicylic acid described in Japanese Examined Patent Publication No. 55-42752 and 59-7385; a metal complex with Zn, Al, Co, Cr, Fe etc. of dialkylsalicylic acid, naphthoic acid and dicarboxylic acid; a sulfonated copper phthalocyanine pigment; organic boron acid slats; fluorine-containing quaternary ammonium salt; calixarene compound etc. can be used. For a color toner besides a black toner, a charge controlling agent impairing the original color should not be used, and white metallic salts of salicylic acid derivatives are preferably used.

The toner for electrophotography optionally includes an external additive. Specific examples thereof include inorganic particulate materials such as silica, titanium oxide, alumina, silicon carbonate, silicon nitride and boron nitride; and particulate resins. These are externally added to mother toner particles to further improve transferability and durability thereof This is because these external additives cover a release agent deteriorating the transferability and durability of a toner and the surface thereof to decrease contact area thereof The inorganic particulate materials are preferably hydrophobized, and hydrophobized particulate metal oxides such as silica and titanium oxide are preferably used. The particulate resins such as polymethylmethacrylate and polystyrene fine particles having an average particle diameter of from 0.05 to 1 μm, which are formed by a soap-free emulsifying polymerization method, are preferably used.

Further, a toner including the hydrophobized silica and hydrophobized titanium oxide as external additives, in which an amount of the hydrophobized silica is larger than that of the hydrophobized titanium oxide, has good charge stability against humidity. A toner including and external additives having a particle diameter larger than that of conventional external additives, such as a silica having a specific surface area of from 20 to 50 $m^2/g$ and particulate resins having an average particle diameter of from 1/100 to 1/8 to that of the toner besides the inorganic particulate materials, has good durability.

This is because the external additives having a particle diameter larger than that of the particulate metal oxides prevent the particulate metal oxides from being buried in mother toner particles, although tending to be buried therein while the toner is mixed and stirred with a carrier, and charged in an image developer for development.

A toner internally including the inorganic particulate materials and particulate resins improves pulverizability as well as transferability and durability although improving less than a toner externally including them. When the external and internal additives are used together, the burial of the external additives in mother toner particles can be prevented and the resultant toner stably has good transferability and durability.

Specific examples of the hydrophobizer include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-ethacryloxypropyltrimethoxysilane, vinyltriacetoxysilane, divinyldichlorosilane, dimethylvinylchlorosilane, octyl-trichlorosilane, decyltrichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used. Besides, as an external additive for the purpose of improving cleanability, lubricants such as a particulate fatty acid metal salt and polyvinylidene fluoride can be used.

The toner for electrophotography can be prepared by known methods such as a pulverization method and a polymerization method. In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used.

The melted and kneaded materials thereby are cooled and pulverized. A hammer mill, rotoplex, etc. crush the cooled materials, and jet stream and mechanical pulverizers pulverize the crushed materials to preferably have an average particle diameter of from 3 to 15 μm. Further, the pulverized materials are classified into the materials having particle diameters of from 5 to 20 μm by a wind-force classifier, etc.

Next, an external additive is preferably added to mother toner particles. The external additive and mother toner particles are mixed and stirred by a mixer such that the external additive covers the surface of the mother toner particles while pulverized. It is essential that the external additives such as inorganic particulate materials and particulate resins are uniformly and firmly fixed to the mother toner particles improve durability of the resultant toner. This is simply an example and the method is not limited thereto.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

The following materials were mixed by a homomixer for 10 min to prepare a solution for forming a coated layer.

| | |
|---|---|
| Acrylic resin solution (a solid content: 50% by weight) | 70 |
| Guanamine solution (a solid content: 70% by weight) | 20 |
| Acidic catalyst (a solid content: 40% by weight) | 1 |
| Silicon resin solution (a solid content: 20% by weight) | 350 |
| Aminosilane (a solid content: 100% by weight) | 5 |
| Conductivized particulate titanium oxide (Surface: ITO treated, Primary particle diameter: 50 nm, Specific volume resistivity; $1.0 \times 10^2\ \Omega \cdot cm$) | 165 |
| Toluene | 700 |

Next, the solution was coated on a core material formed of a burned ferrite powder (Mn ferrite DFC-400M from DOWA IP CREATION Co., Ltd.) having an average particle diameter of 35 μm by SPIRA COTA having an inner temperature of 60° C. from OKADA SEIKO CO., LTD to form a layer having a thickness of 0.3 μm on the surface of the core material, and dried.

Figure 6:
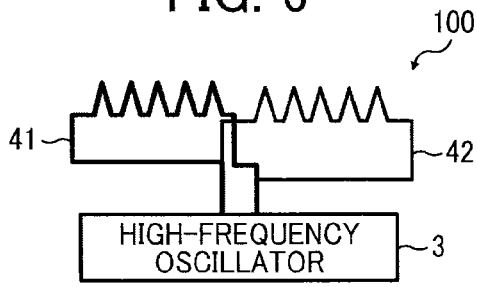
FIG. 6 is a schematic view illustrating the induction heater in Example 1.

The coated carrier was heated by an induction heater 100 in FIG. 6. Two coil circuits (a first coil circuit 41 and a second coil circuit 42) each including 5 rolls of coil were located in connected parallel. A cylinder transferring a carrier was located in a hollow at an inside of the ten rolls of linear coil in total of the two coil circuits. A high-frequency induction current was applied to the two coil circuits to burn at 160° C. A conductive wire forming the coil was a hollow copper wire having a thickness of 1 mm, an outer diameter of 6 mm and an inner diameter of 4 mm. The high-frequency induction current was applied to the conductive wire to heat, and coolant water was run through the hollow to cool. EASYHEAT (10 kW) from AMBRELL was used as an oscillator of high-frequency induction current.

The burned carrier was cooled and sifted by a sieve having an opening of 63 μm to prepare a [carrier 1] having a charge quantity of 35.8-μc/g and a specific volume resistivity of 14.2.

Among the following materials, a colorant, a binder resin and pure water were mixed at a ratio of 1:1:0.5 by a two-roll to prepare a mixture.

| | |
|---|---|
| Polyester resin | 100 |
| Carnauba wax | 5 |
| Charge controlling agent E-84 from Orient Chemical Industries, Ltd. | 1 |
| C.I. Pigment Yellow 180 | 8 |

The mixture was kneaded at 70° C. thereby, and roll temperature was increased to 120° C. and water was vapored to preliminarily prepare a masterbatch. The masterbatch was mixed by HENSCHEL MIXER with the other remaining materials so as to have the above-mentioned formulation, and the mixture was melted and kneaded with a two-roll mill at 120° C. for 40 min to prepare a kneaded mixture. The kneaded mixture was cooled and hardened to prepare a hardened mixture. The hardened mixture was crushed with a hammer mill and pulverized with an air jet pulverizer to prepare a pulverized mixture. The pulverized mixture was classified to prepare mother toner particles having a weight-average particle diameter of 5 μm.

Further, each 1 part of hydrophobized silica and hydrophobized titanium oxide were mixed by HENSCHEL MIXER with 100 parts of the mother toner particles to prepare a yellow toner [toner 1].

7 parts of the [toner 1] and 93 parts of the [carrier 1] were mixed to prepare a developer for electrophotography having a toner concentration of 7% by weight.

Example 2

Figure 7:
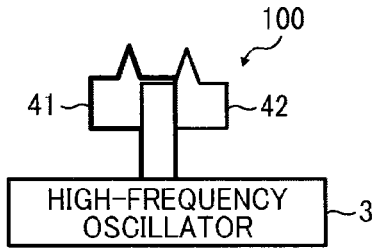
FIG. 7 is a schematic view illustrating the induction heater in Example 2.

The procedure for preparation of the [carrier 1] in Example 1 was repeated to prepare a [carrier 2] having a charge quantity of 36.4-μc/g and a specific volume resistivity of 14.2 except for replacing the induction heater 100 with an induction heater 100 in FIG. 7, in which two coil circuits (a first coil circuit 41 and a second coil circuit 42) each including one roll of coil were located in connected parallel. The procedure for preparation of the developer for electrophotography in Example 1 was repeated except for replacing the [carrier 1] with the [carrier 2].

Example 3

Figure 8:
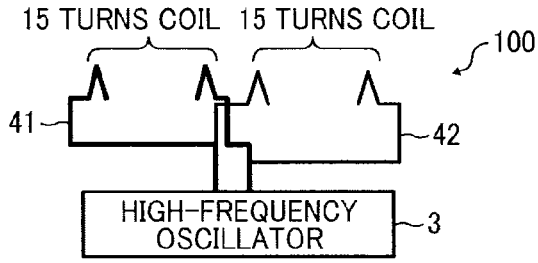
FIG. 8 is a schematic view illustrating the induction heater in Example 3.

The procedure for preparation of the [carrier 1] in Example 1 was repeated to prepare a [carrier 3] having a charge quantity of 36.4-μc/g and a specific volume resistivity of 14.3 except for replacing the induction heater 100 with an induction heater 100 in FIG. 8, in which two coil circuits (a first coil circuit 41 and a second coil circuit 42) each including 15 rolls of coil were located in connected parallel. The procedure for preparation of the developer for electrophotography in Example 1 was repeated except for replacing the [carrier 1] with the [carrier 3].

Example 4

Figure 9:
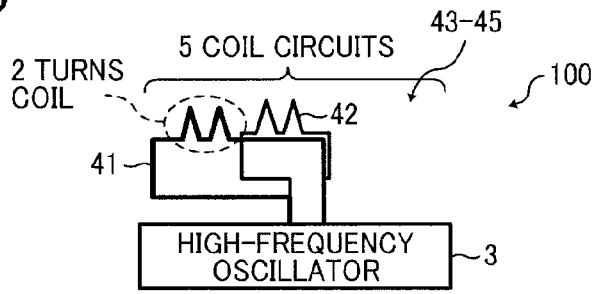
FIG. 9 is a schematic view illustrating the induction heater in Example 4.

The procedure for preparation of the [carrier 1] in Example 1 was repeated to prepare a [carrier 4] having a charge quantity of 35.5-μc/g and a specific volume resistivity of 14.4 except for replacing the induction heater 100 with an induction heater 100 in FIG. 9, in which 5 coil circuits (a first coil circuit 41 to a fifth coil circuit 45) each including 2 rolls of coil were located in connected parallel. The procedure for preparation of the developer for electrophotography in Example 1 was repeated except for replacing the [carrier 1] with the [carrier 4].

Example 5

Figure 10:
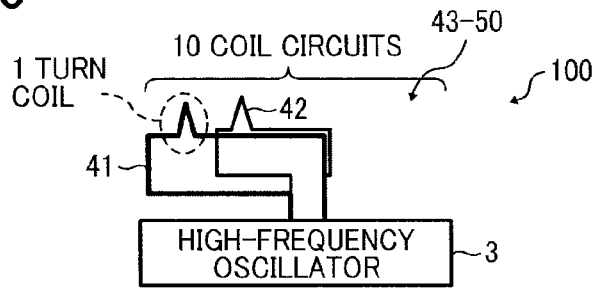
FIG. 10 is a schematic view illustrating the induction heater in Example 5.

The procedure for preparation of the [carrier 1] in Example 1 was repeated to prepare a [carrier 5] having a charge quantity of 35.4-μc/g and a specific volume resistivity of 14.3 except for replacing the induction heater 100 with an induction heater 100 in FIG. 10, in which 10 coil circuits (a first coil circuit 41 to a tenth coil circuit 50) each including one roll of coil were located in connected parallel. The procedure for preparation of the developer for electrophotography in Example 1 was repeated except for replacing the [carrier 1] with the [carrier 5].

Example 6

Figure 11:
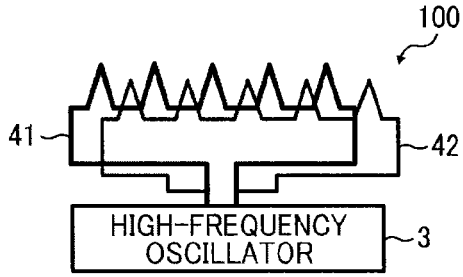
FIG. 11 is a schematic view illustrating the induction heater in Example 6.

The procedure for preparation of the [carrier 1] in Example 1 was repeated to prepare a [carrier 6] having a charge quantity of 35.6-μc/g and a specific volume resistivity of 14.3 except for replacing the induction heater 100 with an induction heater 100 in FIG. 11, in which two coil circuits (a first coil circuit 41 and a second coil circuit 42) each including 5 rolls of coil were located in alternating parallel. The procedure for preparation of the developer for electrophotography in Example 1 was repeated except for replacing the [carrier 1] with the [carrier 6].

Example 7

Figure 12:
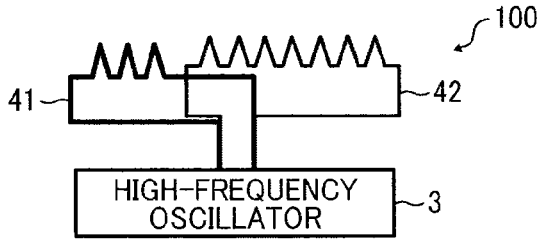
FIG. 12 is a schematic view illustrating the induction heater in Example 7.

The procedure for preparation of the [carrier 1] in Example 1 was repeated to prepare a [carrier 7] having a charge quantity of 36.0-μc/g and a specific volume resistivity of 14.1 except for replacing the induction heater 100 with an induction heater 100 in FIG. 12, in which a first coil circuit 41 including 3 rolls of coil and a second coil circuit 42 including 7 rolls of coil were located in connected parallel. The procedure for preparation of the developer for electrophotography in Example 1 was repeated except for replacing the [carrier 1] with the [carrier 7].

Example 8

Figure 13:
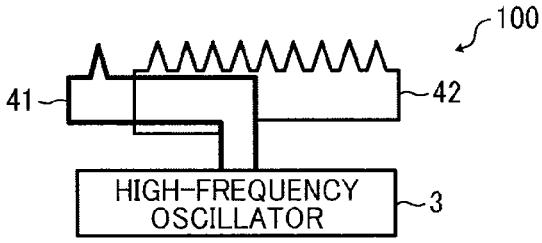
FIG. 13 is a schematic view illustrating the induction heater in Example 8.

The procedure for preparation of the [carrier 1] in Example 1 was repeated to prepare a [carrier 8] having a charge quantity of 36.2-μc/g and a specific volume resistivity of 14.2 except for replacing the induction heater 100 with an induction heater 100 in FIG. 13, in which a first coil circuit 41 including one roll of coil and a second coil circuit 42 including 9 rolls of coil were located in connected parallel. The procedure for preparation of the developer for electrophotography in Example 1 was repeated except for replacing the [carrier 1] with the [carrier 8].

Example 9

The procedure for preparation of the [carrier 1] in Example 1 was repeated to prepare a [carrier 9] having a charge quantity of 36.6-μc/g and a specific volume resistivity of 14.1 except for replacing the induction heater 100 with an induction heater 100 in FIG. 4, in which two coil circuits (a first coil circuit 41 and a second coil circuit 42) each including 5 rolls of coil were located in connected parallel, each connected with different electric sources (a first high-frequency oscillator 3*a* and a second high-frequency oscillator 3*b*), and phases of current frequencies applied from the two electric sources were shifted by 90°.

The procedure for preparation of the developer for electrophotography in Example 1 was repeated except for replacing the [carrier 1] with the [carrier 9].

Comparative Example 1

Figure 14:
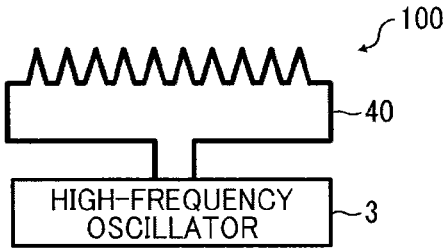
FIG. 14 is a schematic view illustrating the induction heater in Comparative Example 1.

The procedure for preparation of the [carrier 1] in Example 1 was repeated to prepare a [carrier 10] having a charge quantity of 35.6-μc/g and a specific volume resistivity of 14.3 except for replacing the induction heater 100 with an induction heater 100 in FIG. 14 including one series coil circuit 40 including 10 rolls of coil.

The procedure for preparation of the developer for electrophotography in Example 1 was repeated except for replacing the [carrier 1] with the [carrier 10].

Comparative Example 2

Figure 15:
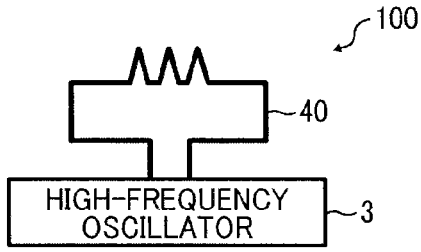
FIG. 15 is a schematic view illustrating the induction heater in Comparative Example 2.
Figure 16:
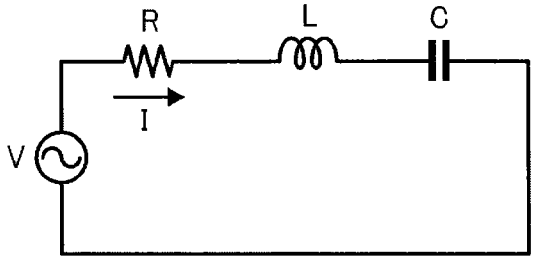
FIG. 16 is a circuit diagram of a resonance LCR circuit included in a high-frequency induction heater.

The procedure for preparation of the [carrier 1] in Example 1 was repeated to prepare a [carrier 11] having a charge quantity of 35.2-μc/g and a specific volume resistivity of 14.3 except for replacing the induction heater 100 with an induction heater 100 in FIG. 15 including one series coil circuit 40 including 3 rolls of coil.

The procedure for preparation of the developer for electrophotography in Example 1 was repeated except for replacing the [carrier 1] with the [carrier 11].

The production capacity and the specific energy consumption of each of the carriers 1 to 11 were evaluated, using each of the developers for electrophotography prepared in Examples 1 to 9 and Comparative Example 1 to 2. The results are shown in Table 1.

TABLE 1

| | | Production capacity | Specific energy consumption |
|---|---|---|---|
| Example 1 | Carrier 1 | Excellent | Good |
| Example 2 | Carrier 2 | Passing | Passing |
| Example 3 | Carrier 3 | Good | Excellent |
| Example 4 | Carrier 4 | Good | Good |
| Example 5 | Carrier 5 | Passing | Passing |
| Example 6 | Carrier 6 | Excellent | Good |
| Example 7 | Carrier 7 | Excellent | Excellent |
| Example 8 | Carrier 8 | Excellent | Excellent |
| Example 9 | Carrier 9 | Good | Good |
| Comparative Example 1 | Carrier 10 | Failing | Passing |
| Comparative Example 2 | Carrier 11 | Failing | Failing |

Measurement and evaluation methods in Table 1 are as follows.

<Production Capacity>

The carrier was continuously fed at a stably burnable speed at 160° C., and the production amount was evaluated.

250 kg/h or more: Excellent 175 to less than 250 kg/h: Good 100 to less 175 kg/h: Passing Less than 100 kg/h: Failing <Specific Energy Consumption>

A ratio of a current applied to the production amount of the carrier was evaluated. kWh/kg Less than 0.008 kWh/kg: Excellent 0.008 to less than 0.002 kWh/kg: Good 0.002 to less 0.03 kWh/kg: Passing 0.03 kWh/kg or more: Failing

Having now fully described the invention, it will be apparent to one of ordinary skill in the art that many changes and modifications can be made thereto without departing from the spirit and scope of the invention as set forth therein.

What is claimed is:

1. A method of preparing carrier for electrophotography including a core material and a coating material layer, the method comprising:

coating a coating material of the coating material layer on the core material;

providing an induction heater including a first circuit and a second circuit, the first circuit being positioned in a location parallel to the second circuit of the induction heater, and the first circuit having a first conductive wire and the second circuit having a second conductive wire, wherein the first conductive wire has a first coil shape including a first number of coil turns and the second conductive wire has a second coil shape including a second number of coil turns;

alternately applying current to the first and second circuit of the induction heater and generating a magnetic line that changes direction and intensity; and burning the coating material by inductively heating the core material by the step of alternately applying current to the first circuit and second circuit of the induction heater.

2. The method of preparing carrier for electrophotography of claim 1, wherein the first number of coil turns being different from the second number of coil turns.

3. The method of preparing carrier for electrophotography of claim 1, further comprising a first electric source; and a second electric source, wherein the first circuit being connected to the first electric source and the second circuit being connected to the second electric source, wherein the first electric source applying a first alternating current to the first circuit and the second electric source applying a second alternating current to the second circuit, and wherein the first alternating current having the same phase frequency as the second alternating current.

4. The method of preparing carrier for electrophotography of claim 1, wherein turns of the first number of coil turns of the first coil shape being alternately positioned in parallel with turns of the second number of coil turns of the second coil shape.

5. The method of preparing carrier for electrophotography of claim 2, wherein turns of the first number of coil turns of the first coil shape being alternately positioned in parallel with turns of the second number of coil turns of the second coil shape.

6. The method of preparing carrier for electrophotography of claim 1, wherein the first circuit being connected in parallel with the second circuit.

7. The method of preparing carrier for electrophotography of claim 6, the first circuit being continuously lined with an end of the second circuit.

* * * * *